US005119614A

United States Patent [19]

Rex

[11] Patent Number: 5,119,614

[45] Date of Patent: Jun. 9, 1992

[54] CONCRETE POST REINFORCING APPARATUS

[75] Inventor: Robert G. Rex, Villanova, Pa.

[73] Assignee: Superior Precast, Pottstown, Pa.

[21] Appl. No.: 646,239

[22] Filed: Jan. 28, 1991

[51] Int. Cl.[5] ..... E04C 3/34

[52] U.S. Cl. ..... 52/720; 52/723; 52/729

[58] Field of Search ..... 52/722, 723, 729, 720, 52/432, 780, 600, 733, 293, 294, 274, 650-653, 725; 405/239, 252; 256/19, 24

[56] References Cited

U.S. PATENT DOCUMENTS

| | | | |
|---|---|---|---|
| 411,360 | 9/1889 | Stempel | 52/725 |
| 1,045,521 | 11/1912 | Conzelman | 52/274 |
| 1,572,669 | 2/1926 | Muller | 52/722 |
| 1,714,949 | 5/1929 | Collier et al. | 256/19 |
| 2,020,407 | 11/1935 | Forster | 52/652 |
| 3,577,504 | 5/1971 | Lipski | 52/723 |

FOREIGN PATENT DOCUMENTS

| | | | |
|---|---|---|---|
| 479814 | 1/1952 | Canada | 52/723 |
| 482687 | 1/1917 | France | 52/723 |

OTHER PUBLICATIONS

Commonwealth of Pennsylvania, Dept. of Transportation, "Submission Procedures for Noise Barrier".

*Primary Examiner*—James L. Ridgill, Jr.
*Attorney, Agent, or Firm*—Wall and Roehrig

[57] ABSTRACT

A concrete post and panel noise barrier in which the opposed side walls of the post contain vertical grooves for slidably receiving the panels. Each post further contains two parallel rows of vertically disposed reinforcing bars positioned adjacent the front and back walls of the post. The two rows of reinforcing bars are further strengthened by horizontally disposed connector units that include an endless tie rod positioned between the grooves that loops around at least one bar in each row and a pair of stirrup wires that pass around the outside of the rows of reinforcing bars. The ends of each stirrup wire are turned inward about the end bars in the row and are crossed over each other before being brought into engagement with the tie rod.

8 Claims, 3 Drawing Sheets

CONCRETE POST REINFORCING APPARATUS

BACKGROUND OF THE INVENTION

This invention relates to a concrete post and panel noise barrier, and in particular, to a system for reinforcing a grooved post used in this type of barrier.

Concrete posts have long been used in applications such as concrete noise barriers. Such posts are commonly reinforced with metal bars or mesh in order that the posts can bear high loads. Differing sectional shapes of such posts require that the reinforcing assemblies have specialized design to adequately handle lateral as well as axial stress. Typically, such concrete posts or columns are vertically reinforced by a system of longitudinal bars, and laterally reinforced by ties or by continuous, closely spaced spirals. Such lateral reinforcements restrain the longitudinal bars from buckling when the concrete is placed under axial load in actual operation. They also directly restrain the bulging tendency of the concrete itself, enabling the concrete to resist high axial loads when placed in compression. Without such ties, the columns are apt to undergo longitudinal fractures and ultimate structural failure.

While posts of square or rectangular sections can be strongly reinforced by a simple system of ties rather inexpensively, those posts used for walls such as tall highway noise barriers must accommodate panel members between the posts. Such noise barriers have become common along heavily trafficked highways and are described in greater detail in U.S. Pat. Nos. 4,605,090 and 4,862,992. Safety considerations require that post and panel barriers be able to withstand heavy wind loading as well as other lateral axial stresses. Modern designs of such noise barriers utilize spaced apart posts having side grooves for slidably receiving large flat concrete panels. These posts require more complex reinforcing assemblies of ties and stirrups. A reinforcing assembly for a post suitable for use in this type of barrier system is disclosed in Pennsylvania State Contract Guidelines dated Jan. 23, 1989 and issued by the Department of Transportation, Harrisburg, Pa. This post assembly requires the use of heavy reinforcing stirrups which are expensive to construct and difficult to install. Additionally, the component parts of the stirrup assembly are not integrated into a coherent unit. As a result, the concrete will thereby crack under load and ultimately fail.

SUMMARY OF THE INVENTION

While the present invention is well adapted for use in noise barrier systems, it is by no means limited to such use. The apparatus of the present invention can be used in supports and strengthens any type concrete post, especially one having deep mural grooves or recesses.

It is therefore an object of the invention to improve concrete post and panel noise barriers.

It is another object of the invention to provide a durable, stress resistant system for reinforcing concrete posts having vertically disposed grooves formed therein.

It is yet another object of the invention to provide a reinforced concrete post and panel noise barrier which will prevent buckling of the post when the post is placed under axial and lateral loading.

It is still another object of the invention to provide a stress resistant, durable, economically constructed system for reinforcing grooved concrete posts.

These and other objects of the present invention are attained in a concrete post and panel noise barrier by means of a reinforcing system formed of metal bars or rods that are brought together to strengthen all sections of a grooved post especially those weaker sections found in and about the groove regions. The post has two vertically disposed grooves or recesses formed in its opposing side walls. A first row of vertical bars are positioned adjacent the front wall of the post while a second parallel row is similarly positioned adjacent to the back wall. The bars in each row extend laterally beyond the bottom walls of the opposed grooves. At least one, and preferably a plurality, of spaced connector units are used to tie the vertical rows together in assembly and to further strengthen the post behind the grooves. Each unit contains an endless tie rod that is looped about at least one bar in each of the two vertical rows and passes across the post between the grooves. Stirrup wires are used to further prevent the bars from buckling under load. Each wire passes along the outside of one row of reinforcing bars and is bent inwardly around the two end bars in the row to form arms that cross one over the other. The distal segments of the arms are further bent to bring them adjacent to the tie rod in the grooved region.

BRIEF DESCRIPTION OF THE DRAWINGS

The above and many other objects, features, and advantages of this invention will become apparent from the ensuing detailed description of a preferred embodiment of this invention, which should be read in conjunction with the accompanying drawings wherein.

DETAILED DESCRIPTION OF THE INVENTION

Figure 1:
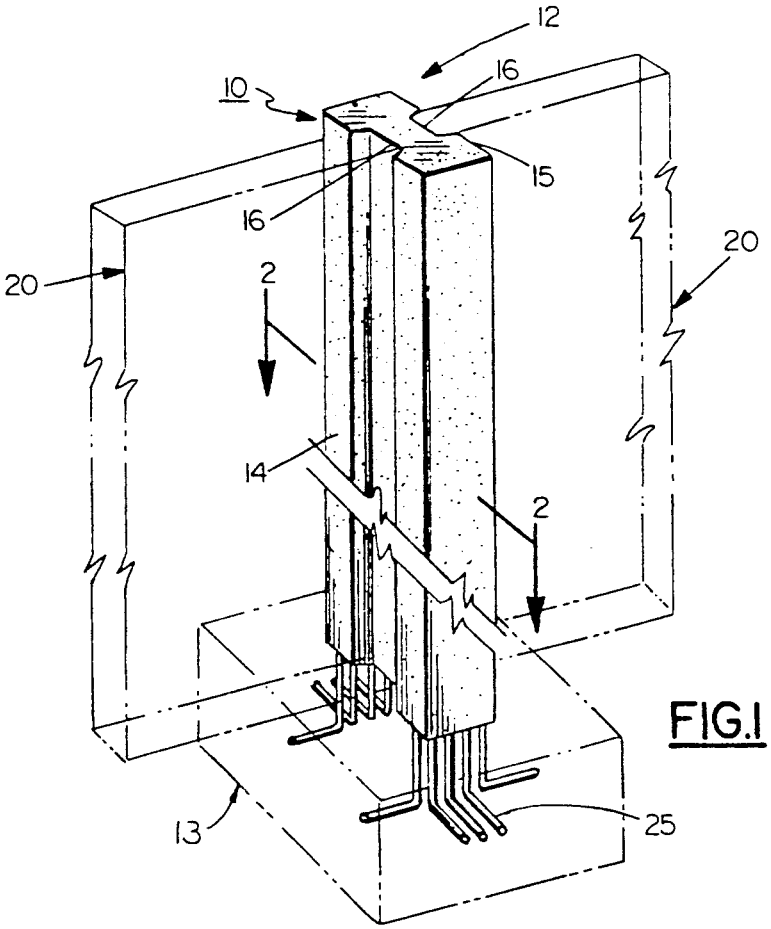
FIG. 1 is a perspective view showing a concrete post and panel noise barrier having a post embodying the reinforcing system of the present invention.

Referring now to the drawings, there is shown a concrete post and panel noise barrier, generally referenced 10, that is presently being employed adjacent to many heavily travelled highways to protect those living or working near the highway from unwanted traffic noise. This type of barrier construction has become popular because it is not only aesthetically pleasing, but also relatively easy to fabricate and erect. As noted above, however, the barrier, under certain conditions, can experience heavy loading due to high winds and the like.

In this type of construction, vertical posts 12 are typically mounted upon anchor pads 13 which, in turn, are recessed in the ground. Each post is generally rectangular in form having a pair of opposed side walls 14 and 15 each of which contains a vertically disposed groove 16. In order to properly support the panels, the grooves formed in the post must be relatively deep.

Each groove includes a flat bottom wall 18 and two inwardly converging side walls 19—19. In assembly, concrete panels 20—20 are slidably received within the grooves and rest securely in an upright position on the anchor pads. Gaskets 21—21 are placed between the posts and the panels to close the joints therebetween.

As can be seen from the drawings, the relatively deep grooves or recesses formed in the posts represent a reduction in the cross-sectional area of the post. The restricted area between the grooves is thus weakened and it also makes tying the rows of reinforcing bars together rather difficult. As will be explained in greater detail below, the reinforcing system of the present invention is specifically designed for use in association with this type of post to provide maximum resistance to stress using a minimal amount of material.

The present reinforcing system includes vertically disposed reinforcing bars 25—25 that are passed downwardly through the post into the supporting anchor pad. The bottom end of each bar is turned about 90° to enable the bars to be securely seated in the pad. The bars are assembled in two parallel rows that include a front row 27 positioned adjacent the front wall 28 of the post and a back row 30 positioned adjacent the rear wall 31. The rows extend laterally beyond the bottom walls of the opposed recesses to help strengthen the four protruding corner sections 33—33 of the post.

In practice, the post generally extends upwardly from the support pad to a height that can be between 7 and 15 feet. As can be seen, the vertically extended bars running upwardly through the post are in actuality long slender columns which, if not properly supported, will buckle under load. A series of horizontally aligned connector units 35—35 are used in the present system to prevent the columns from buckling and to provide additional strength to the post where it is most needed between the grooves.

Figure 3:
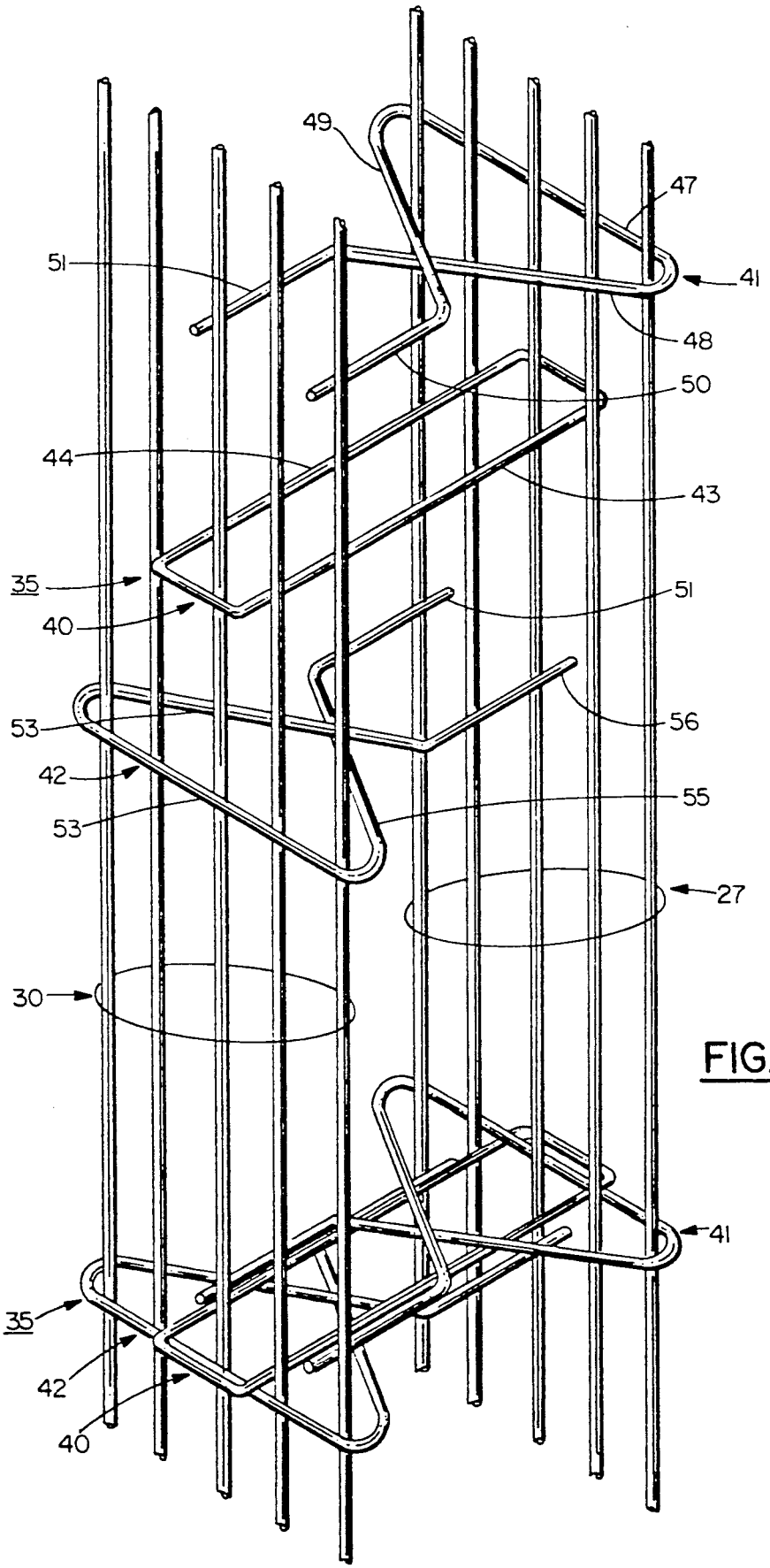
FIG. 3 is a partial perspective view of the reinforcing system shown in FIG. 2, further illustrating the connector units employed in the system in both an assembled condition and an exploded condition.

As illustrated in FIG. 3, each connector unit contains three component parts that include an endless tie rod 40, a front stirrup wire 41 and a back stirrup wire 42. The tie rod is centered in the post between the opposed grooves. The rod is looped about at least one vertical bar in both the front and rear rows before being welded shut in the field. The tie rod is generally rectangular in shape and has two parallel legs 43 and 44 that pass through the grooved section adjacent to the bottom walls of the grooves.

The front stirrup wire 41 is mounted above the tie rod and has a body section 47 that passes along the outside of the front row of reinforcing bars. The wire is bent around the two end bars in the row to establish a pair of arms 48 and 49 that cross each other at about the front to back axis of the post. The bend is tight enough so that the arms pass well inside the corners of the grooves. The distal segments 50 and 51 of the arms are further bent inwardly to bring them into contiguous relationship with the two parallel legs of the tie rod.

Figure 2:
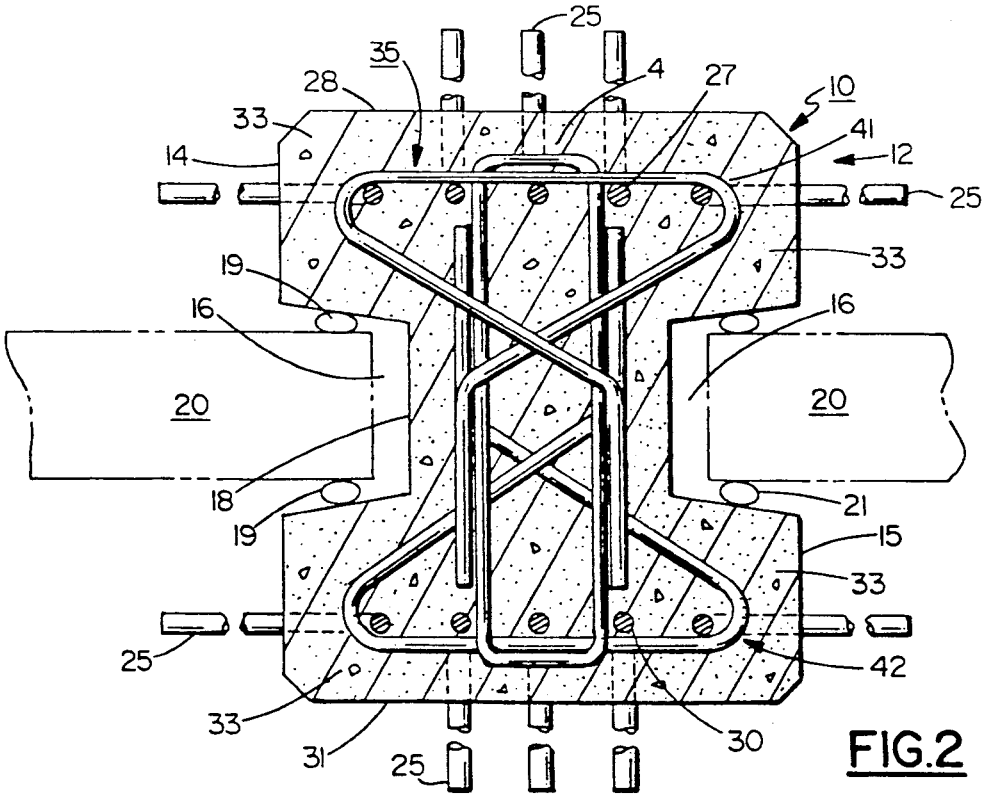
FIG. 2 is an enlarged section taken along lines 2—2 in FIG. 1 showing further features of the reinforcing system of the present invention.

The back stirrup wire 42 is similarly configured as the front stirrup wire to provide a body section 53, a pair of bent arms 54 and 55, and bent distal sections 56, 57 that also parallel the legs of the tie rod. The back stirrup wire is installed beneath the tie rod and is arranged to pass outside the back row of reinforcing bars as illustrated in FIGS. 2 and 3.

The component parts of the connector units can be joined together and to the reinforcing bars in the field by spot welds or wire ties to hold the reinforcing system in place prior to pouring the post. As should be evident from the disclosure above, the present reinforcing system is designed to provide strength to a grooved post in those post areas that most require this type of reinforcing, that is the center section of the post and the four extended center corner sections. Because the connector unit components are strategically located within the critical sections of the post, and are brought together as described above to form a composite assembly with the vertical reinforcing bars, the component parts of the unit can be fabricated from materials that are thinner than the reinforcing bars without sacrificing strength. This, in turn, leads to a considerable reduction in the cost of construction.

The present reinforcing structure can also be used to reinforce grooved posts that are elongated along the front to back axis of the post. In this embodiment of the invention, the distal segments of the two stirrup wires do not overlap, but are simply directed inwardly towards each other and are brought into abutting contact to strengthen the post region between the grooves.

Figure 4:
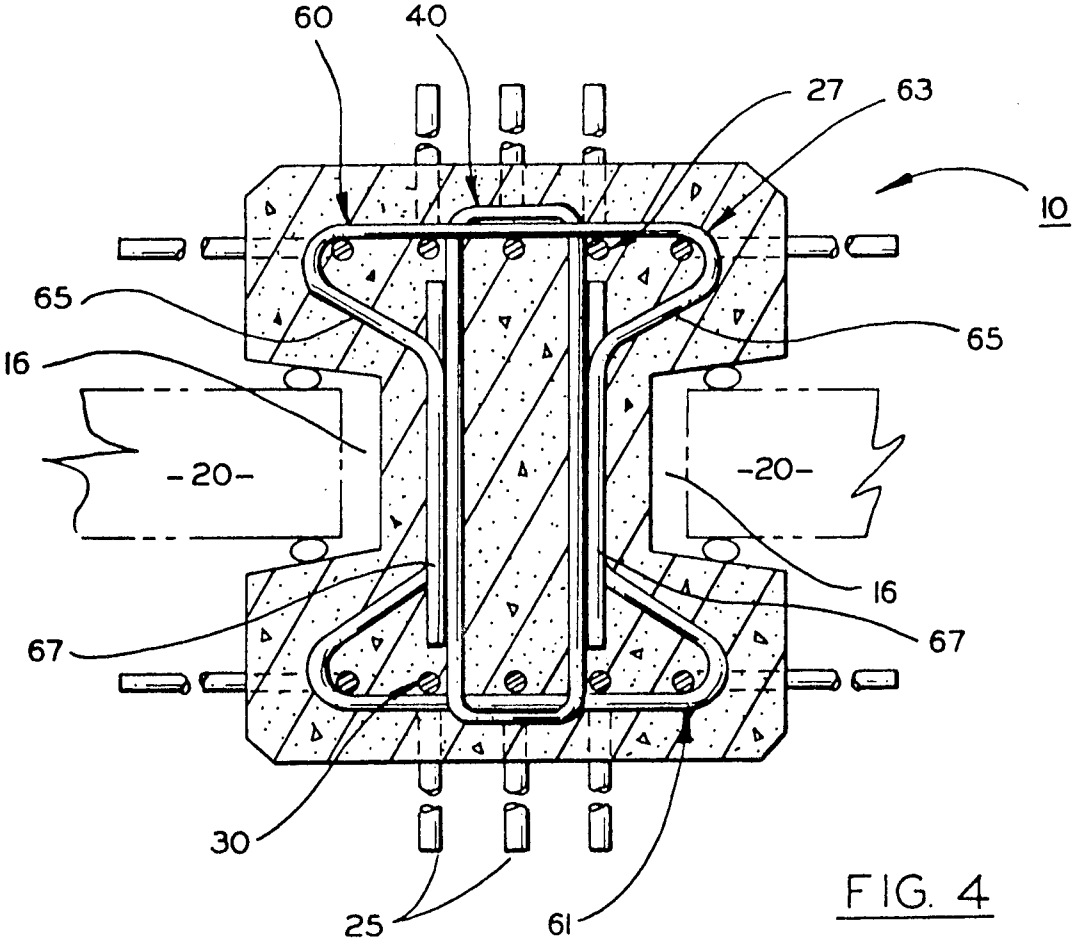
FIG. 4 is an enlarged section showing another embodiment of the present invention.

Turning now to FIG. 4, there is shown a second embodiment of the connector unit utilized in the present invention. Again, the post 12 is mounted upon an anchor pad and the panels 20—20 are situated in grooves 16—16 and arranged to rest in an upright position upon the pad. Vertically disposed reinforcing bars are mounted in rows 27 & 30 along the front and back faces of the post as described in greater detail above. A tie rod 40 is centrally positioned in the post and is wrapped about the two rows of reinforcing bars as shown. A first top stirrup 60 is mounted over the tie rod and a second lower bottom stirrup 61 of similar construction is mounted below the tie rod. Each stirrup includes a body section 63 positioned outside one of the reinforcing bar rows. The body section is bent around the two end bars in the row to form arms 65—65 that turn inwardly. Each arm is further bent to form distal ends 67—67 that parallel the tie rod to produce a hairpin-shaped member. The distal end of each arm extends inwardly so that it passes through the center of the post and well beyond the groove 16 to completely reinforce the grooved area.

Here again, the connector units are spaced vertically along the post and can be secured to the reinforcing bars by wire or spot welds.

While this invention has been explained with reference to the structure disclosed herein, it is not confined to the details set forth and this application is intended to cover any modifications and changes as may come within the scope of the following claims.

What is claimed is:

1. In a vertical concrete post having a generally I beam cross section with a pair of flanges spaced apart by a web forming opposed vertical grooves and a first row of reinforcing bars spaced apart from a second parallel row of reinforcing bars, the rows being vertically disposed within the flanges of the post, reinforcing apparatus comprising:

at least one connector unit internally mounted within the web of a post for connecting the two rows of reinforcing bars and strengthening the post which includes:

an endless tie rod lying in a horizontal plane that passes around the outside of at least one reinforcing bar in each of said rows having parallel legs that pass through the web of the post;

a first stirrup wire lying above said tie rod that passes along the outside of one of said rows of reinforcing bars and being bent inwardly around end bars in said row to form a pair of arms, each arm being further bent inwardly so that the distal segments of said arms are adjacent to and parallel with the tie rod legs;

a second stirrup wire lying beneath the tie rod that passes along the outside of the other row of reinforcing bars and being bent inwardly around end bars in the row to form a pair of arms, each arm being further bent inwardly so that the distal segments of said arms are adjacent to and parallel with the tie rod legs; and said tie rod, first stirrup wire and said second stirrup wire having a diameter substantially smaller than the first and second rows of reinforcing bars.

2. The apparatus of claim 1 wherein the distal segments of said first stirrup wire pass behind the distal segments of the second stirrup wire so that the distal segments of the wires extend outwardly away from each other.

3. The apparatus of claim 1 wherein the distal segments of the two stirrup wires extend inwardly toward each other.

4. The apparatus of claim 1 wherein said rows of reinforcing bars are longer than the width of said tie rod to accommodate for grooves formed in the side walls of said post.

5. The apparatus of claim 1 wherein each reinforcing bar has a cross-sectional area that is greater than the cross-sectional area of the tie rod and the stirrup wires.

6. The apparatus of claim 1 that includes a plurality of vertically spaced connector units.

7. Apparatus for supporting wall panels in a noise barrier that includes a rectangular shaped, vertically disposed concrete post having vertically disposed grooves formed in opposing side walls thereof for slidably receiving wall panels therein, a first row of reinforcing bars vertically mounted in the post adjacent to the front wall of the post and a second parallel row of reinforcing bars vertically mounted in the post adjacent the back wall of the post, said grooves extending inwardly between said rows, at least one endless tie rod lying in a horizontal plane between said grooves and being arranged to pass about at least one reinforcing bar in each row to form a pair of parallel legs that pass adjacent opposed bottom walls of the grooves, a first stirrup wire lying above the tie rod that is arranged to pass along the outside of one row of reinforcing bars and being bent inwardly around the end bars in said row to form a pair of arms that cross one over the other, each arm being further bent inwardly so that said distal segments lie adjacent to the legs of the tie rod, and a second stirrup wire lying beneath the tie rod that is arranged to pass along the outside of the other row of reinforcing bars and being bent inwardly around the end bars in said row to form a pair of arms that cross one over the other, each arm being further bent inwardly so that its distal segment lies adjacent to one of the legs.

8. The apparatus of claim 7 further including a plurality of tie rods and stirrup wire units spaced along the reinforcing bars.

* * * * *